US005992496A

United States Patent [19]

Lee

[11] Patent Number: 5,992,496

[45] Date of Patent: Nov. 30, 1999

[54] RESILIENT SUSPENSION DEVICE FOR FOLDABLE DOORS

[76] Inventor: Chen Hsiang Lee, Suite 1, No. 10, Lane 73, Kaohsiung, Taiwan

[21] Appl. No.: 09/241,909

[22] Filed: Feb. 2, 1999

[51] Int. Cl.[6] ..... E05D 15/26

[52] U.S. Cl. ..... 160/199; 16/87 R

[58] Field of Search ..... 16/87 R, 93 R, 16/95 R; 160/199, 345, 341, 84.08

[56] References Cited

U.S. PATENT DOCUMENTS

| | | | |
|---|---|---|---|
| 195,148 | 9/1877 | McQuatters | 16/95 R |
| 2,690,585 | 10/1954 | Nordahl | 16/95 R |
| 2,912,713 | 11/1959 | Nelson | 16/95 R |
| 2,994,099 | 8/1961 | Richards | 160/199 |
| 3,331,427 | 7/1967 | Colombo | 160/199 |
| 3,449,790 | 6/1969 | Felsner et al. | 16/93 D |
| 3,473,266 | 10/1969 | Miller | 16/87 R |
| 3,798,839 | 3/1974 | Kaufman | 160/199 |
| 4,073,092 | 2/1978 | Williams | 160/199 |

FOREIGN PATENT DOCUMENTS

| | | | |
|---|---|---|---|
| 1246357 | 10/1960 | France | 160/199 |

*Primary Examiner*—Blair M. Johnson
*Attorney, Agent, or Firm*—Rosenberg, Klein & Bilker

[57] ABSTRACT

A foldable door includes a track and a number of foldable door leaves. Each door leaf includes a compartment and two screw holes. Each door leaf is carried by a slider slidably received in the groove. The compartment of each door leaf receives a suspension member that includes a stem having an upper end connected to the slider to move therewith. Two resilient arms extend outwardly and upwardly from the stem and away from each other. Each resilient arm terminates at a positioning member located on top of an associated screw hole of the associated door leaf. Each positioning member includes a hole, and a fastener extends through the hole of each positioning member and the associated screw hole. The resiliency of the resilient arms absorbs a portion of impact to the suspension devices during folding and unfolding of the foldable door.

2 Claims, 5 Drawing Sheets

RESILIENT SUSPENSION DEVICE FOR FOLDABLE DOORS

BACKGROUND OF THE INVENTION

1. Field of the Invention

The present invention relates to a resilient suspension device for foldable doors for allowing easy folding and unfolding of the foldable doors.

2. Description of the Related Art

FIG. 1 of the drawings illustrates a conventional foldable door 7 that includes a number of foldable door leaves 71 and a handle 73 mounted to an outermost door leaf. Each door leaf 71 includes a suspension member 72 connected to a slider 74 that is slidable along a track 8. It is, however, found that the force applied to the handle 73 cannot be smoothly transmitted to the sliders 74. This results in non-smooth sliding movements of the sliders 74 in the track 8. As a result, the suspension members 72 tend to break or to disengage from the door leaf 71 after a term of use. The present invention is intended to provide an improved resilient suspension device that mitigates and/or obviates this problem.

SUMMARY OF THE INVENTION

In accordance with the present invention, a foldable door includes a track and a plurality of foldable door leaves. Each door leaf includes a compartment and two screw holes. Each door leaf is carried by a slider slidably received in the groove. The compartment of each door leaf receives a suspension member that comprises a stem having an upper end connected to the slider to move therewith. Two resilient arms extend outwardly and upwardly from the stem and away from each other. Each resilient arm terminates at a positioning member located on top of an associated screw hole of the associated door leaf. Each positioning member includes a hole, and a fastener extends through the hole of each positioning member and the associated screw hole. The resiliency of the resilient arms may absorb a portion of impact to the suspension devices during folding and unfolding of the foldable door.

In a preferred embodiment of the invention, the suspension device includes a mediate portion connected to a lower end of the stem, and the resilient arms extend upwardly and outwardly from the mediate portion.

Other objects, advantages, and novel features of the invention will become more apparent from the following detailed description when taken in conjunction with the accompanying drawings.

DETAILED DESCRIPTION OF THE PREFERRED EMBODIMENT

Figure 3:
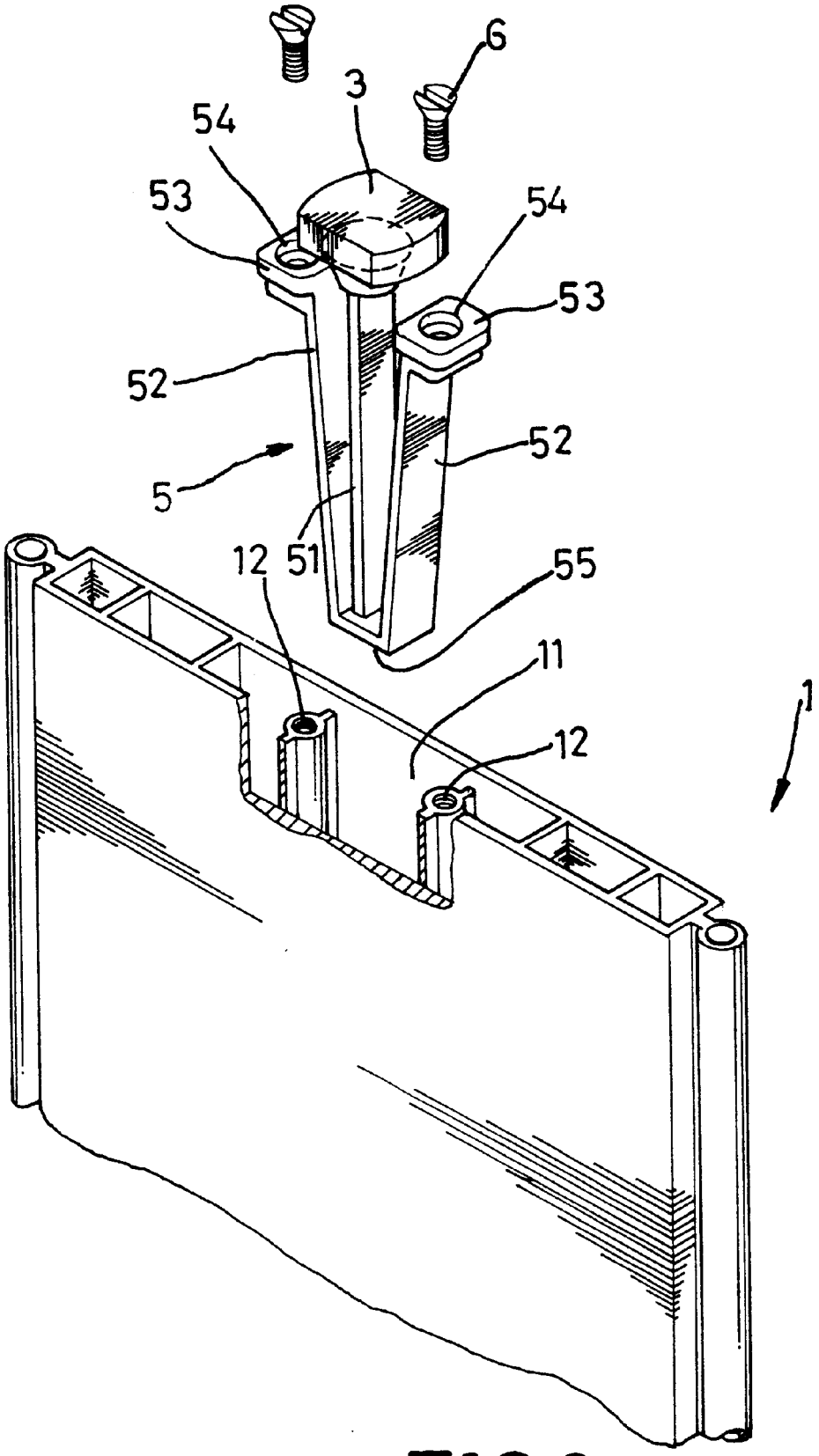
FIG. 3 is an exploded perspective view, partly cutaway, of a door leaf and a suspension device in accordance with the present invention.
Figure 5:
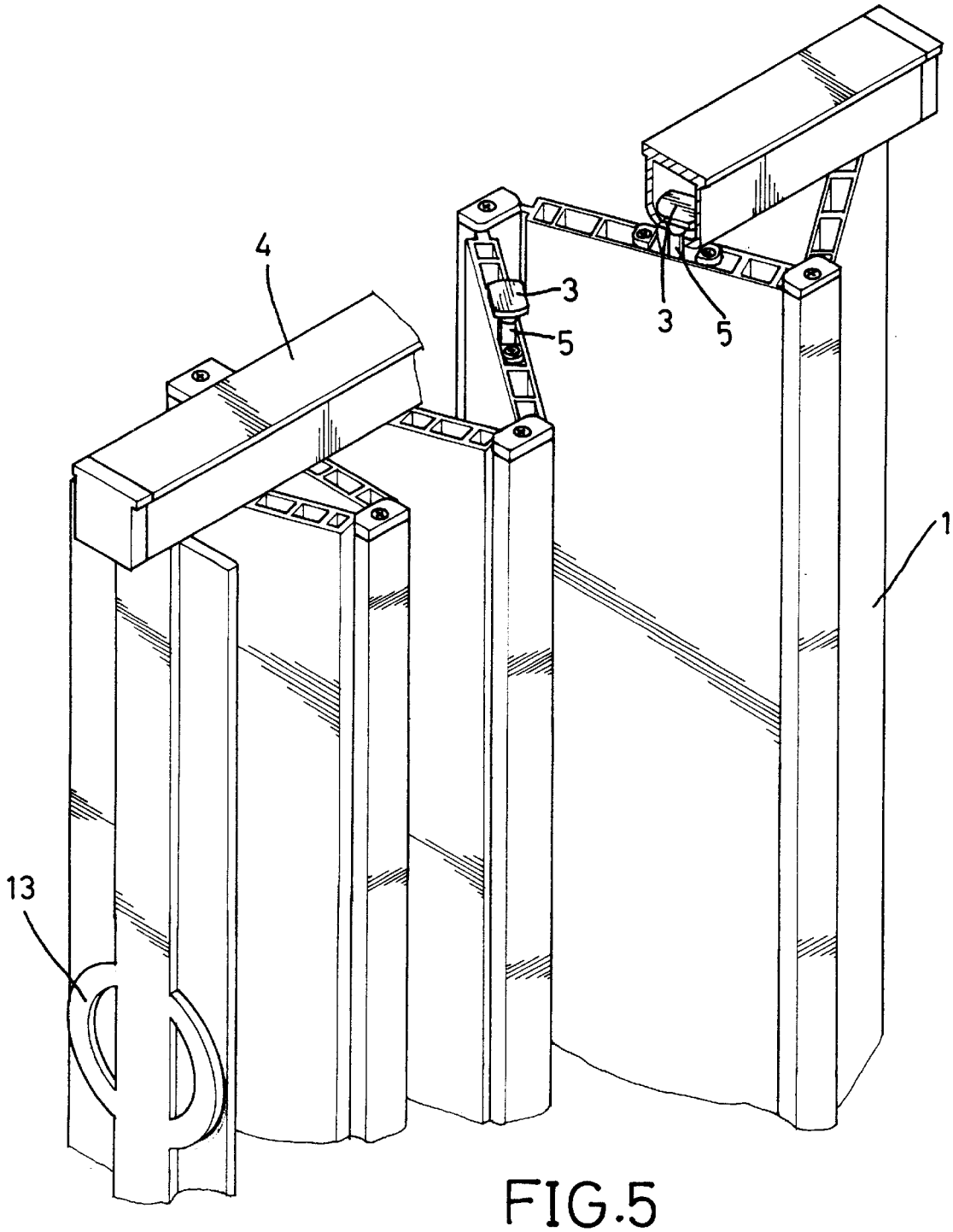
FIG. 5 is a perspective view of the foldable door in accordance with the present invention.

Referring to FIG. 5, a foldable door in accordance with the present invention includes a track 4, a plurality of foldable door leaves 1 that are pivotally connected one by one. Each door leaf 1 includes a resilient suspension device 5 connected to a slider 3 that is slidable in the track 4. Referring to FIG. 3, each door leaf 1 includes a compartment 11 and two screw holes 12. Each resilient suspension device 5 includes a stem 51 having an upper end connected to the slider 3 and a lower end. A substantially V-shaped resilient member is attached to the stem 51. In this embodiment, the resilient member includes a mediate portion 55 connected to the lower end of the stem 51 and two arms 52 respectively extend upwardly and outwardly from the mediate portion 55 and away from each other. Each arm 52 terminates at a positioning member 53 with a hole 54.

Figure 1:
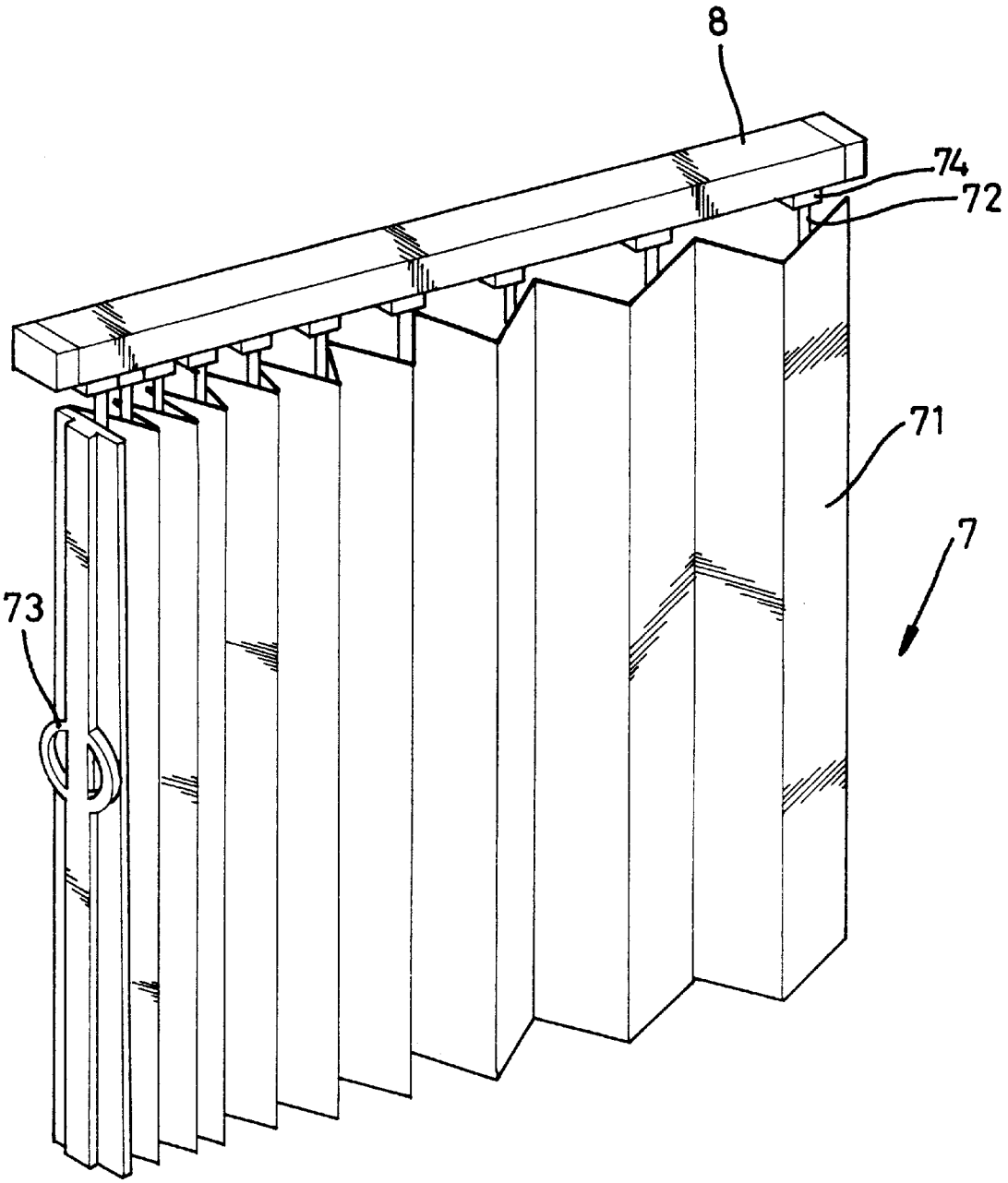
FIG.1 PRIOR ART
FIG. 1 is a perspective view of a conventional foldable door.
Figure 2:
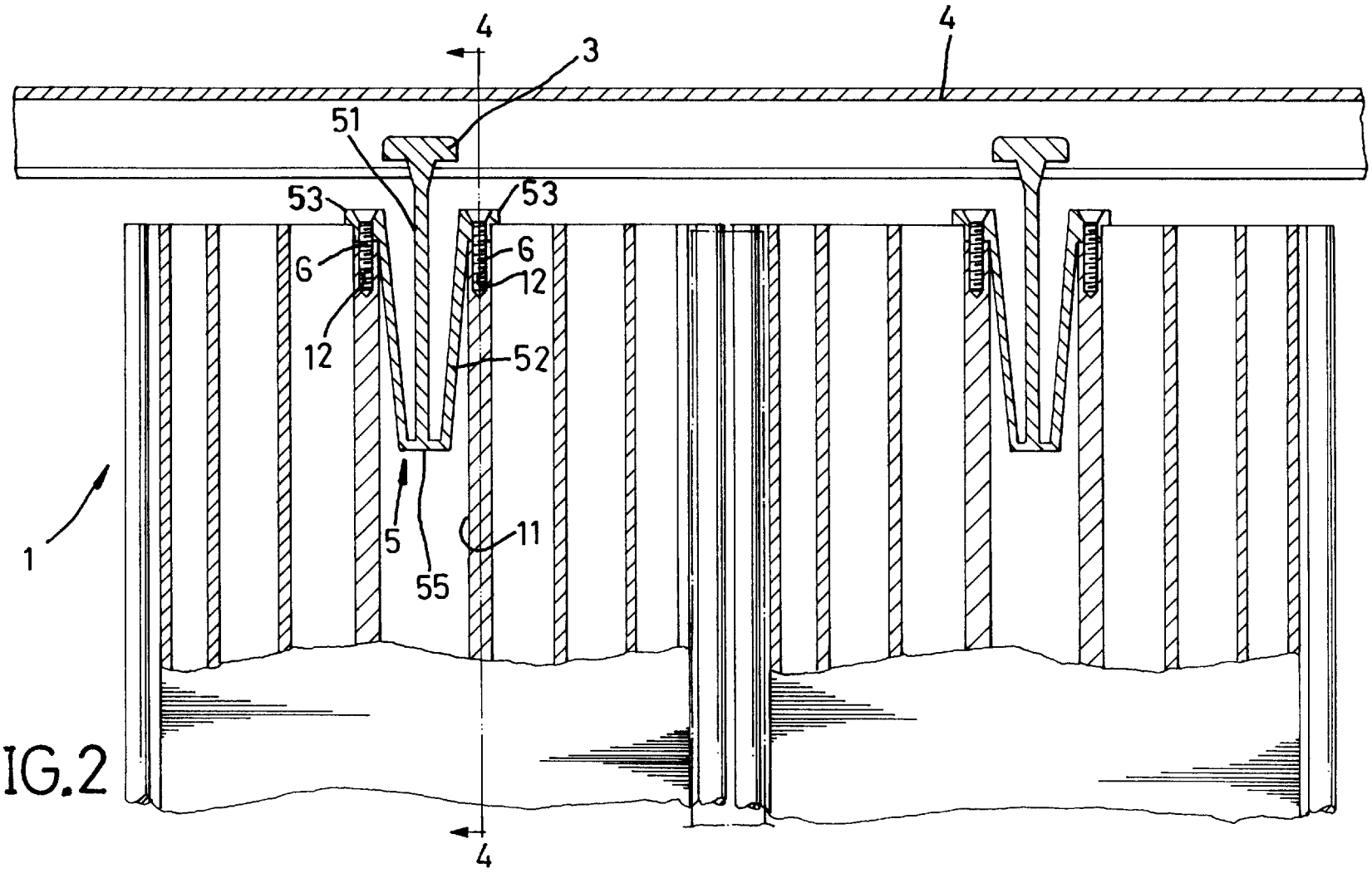
FIG. 2 is a side view, partially sectioned, of a portion of a foldable door in accordance with the present invention.
Figure 4:
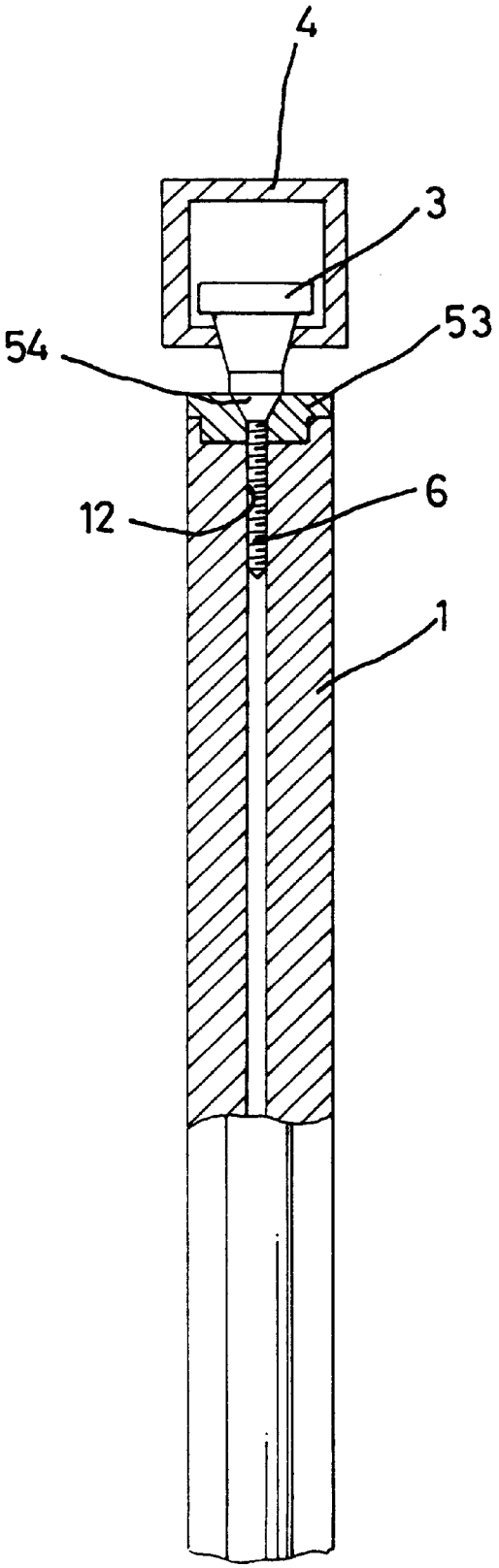
FIG. 4 is a sectional view taken along line 4—4 in FIG. 2.

In assembly, referring to FIGS. 2 and 4, the resilient suspension device 5 is inserted into the compartment 11 of the door leaf 1 with the two positioning members 53 respectively located on top of the screw holes 12. A fastener 6 (a bolt or screw) is extended through the hole 54 of each positioning member 53 and the associated screw hole 12. The slider 3 is slidably received in the track 4.

In use, when the door leaves 1 are folded or unfolded at a fast speed by grasping a handle 13 attached to an outermost door leaf 1 (FIG. 5), the resiliency of the resilient arms 52 may absorb a portion of impact to the suspension devices 5. Thus, the foldable door is more durable by means of provision of the resilient arms 52.

Although the invention has been explained in relation to its preferred embodiment, it is to be understood that many other possible modifications and variations can be made without departing from the spirit and scope of the invention as hereinafter claimed.

What is claimed is:

1. A foldable door comprising a track having a groove and a plurality of foldable door leaves, each said door leaf including a compartment and two screw holes, each said door leaf being carried by a slider slidably received in the groove, said compartment of each said door leaf receiving a suspension device, each said suspension device comprising a stem having an upper end connected to the slider to move therewith and a lower end, two resilient arms extending outwardly and upwardly from the lower end of the stem and away from each other, each said resilient arm terminating at a positioning member located on top of an associated said screw hole of the associated door leaf, each said positioning member including a hole, and a fastener extending through said hole of each said positioning member and the associated screw hole.

2. The foldable door as claimed in claim 1, wherein the suspension device includes a mediate portion connected to the lower end of the stem, and the resilient arms extend upwardly and outwardly from the mediate portion.

* * * * *